US005088428A

United States Patent [19]

Frye

[11] Patent Number: 5,088,428

[45] Date of Patent: Feb. 18, 1992

[54] BUTTON ATTACHING MACHINE AND METHOD

[75] Inventor: Ricky J. Frye, Miamisburg, Ohio

[73] Assignee: MIM Industries, Inc., Miamisburg, Ohio

[21] Appl. No.: 438,255

[22] Filed: Nov. 15, 1989

Related U.S. Application Data

[63] Continuation-in-part of Ser. No. 408,891, Sep. 18, 1989, abandoned.

[51] Int. Cl.[5] ..... D05B 3/22

[52] U.S. Cl. ..... 112/265.1; 112/112; 112/115; 112/121.12

[58] Field of Search ..... 112/112, 110, 111, 113, 112/114, 115, 265.1, 121.12, 121.15

[56] References Cited

U.S. PATENT DOCUMENTS

| | | | |
|---|---|---|---|
| 1,343,149 | 6/1920 | Morgen et al. | 112/115 |
| 1,408,474 | 3/1922 | Russell | 112/115 |
| 3,483,833 | 12/1969 | Conner, Jr. | 112/113 |
| 3,633,524 | 1/1972 | Hoffsommer et al. | 112/113 |
| 4,690,077 | 9/1987 | Nirenberg | 112/113 |
| 4,714,034 | 12/1987 | Riss et al. | 112/113. |

FOREIGN PATENT DOCUMENTS

| | | | |
|---|---|---|---|
| 0263479 | 11/1986 | Japan | 112/110 |

*Primary Examiner*—Peter Nerbun
*Attorney, Agent, or Firm*—Donald P. Gillette

[57] ABSTRACT

A programmable sewing machine having movable work holding means, first and second separable button holding means, button supporting means movable into proximity with the button holding means and means to move the button holding means toward the sewing machine bed.

20 Claims, 3 Drawing Sheets

BUTTON ATTACHING MACHINE AND METHOD

This is a continuation-in-part of co-pending application Ser. No. 408,891, filed Sept. 18, 1989, now abandoned.

BACKGROUND OF THE INVENTION

1. Field of the Invention

This invention relates to the attachment of rows of buttons to work pieces and particularly to the attachment of rows of buttons to sleeves of jackets and the like.

In the production of jackets, particularly suit jackets worn by men, it is standard practice to sew a row of buttons near the end of each sleeve. Typically, there are three or four buttons in such a row, but there may be more than four or less than three. While each button can be sewn onto a sleeve by carefully aligning it in the proper orientation and using a suitable tacking machine, it is desirable to automate the process as much as possible, not only to accomplish it with greater speed but also with greater neatness and uniformity.

2. Objects and Summary of the Invention

It is one of the objects of this invention to provide means usable with an automatic sewing machine to attach a row of several buttons to a work piece in what is essentially one operation..

Another object is to provide a fixture for a programmable sewing machine to allow it to hold and attach a row of several buttons to a work piece constituting the sleeve of a jacket.

A further object is to provide a method for attaching a row of buttons to a work piece in one operation consisting of several steps.

Still further objects will be apparent to those skilled in the art after they have studied the following description and the accompanying drawings.

In accordance with this invention, the buttons are first placed on pins at specific positions along an arm movably attached to a programmable sewing machine at a location not far from the stitch-forming mechanism. Then the arm, with the buttons supported on it in exact positions, is moved into the stitch-forming region and, specifically, between two button-holding devices mounted on the work holder so that they can move with respect to it as well as moving with respect to each other. These devices have juxtaposed edges, which, at the time the buttons are moved into place between them, are laterally spaced far enough apart to be out of the way of the buttons.

When the row of buttons is in the correct position, the button-holding devices are forced toward each other by suitable actuating means to press the juxtaposed edges against the entire row of buttons. These edges have recesses to receive edge portions of the buttons and to hold the buttons fast so that they cannot move.

The arm on which the have been supported is then moved down far enough for the tops of the pins to be lower than the lower surfaces of the buttons and is retracted to the location at which another set of buttons can be placed on the pins.

After the opposing button-holding devices have a firm grip on the buttons, a work piece is placed on a cloth plate on the bed of the sewing machine, and the button-holding devices are pressed down on the work piece to serve as a clamp to hold it firmly in place on the cloth plate.

The button-holding devices are supported on the work holder of the machine in place of the usual clamp and are pivotally mounted so that they can swing outward to provide space for the buttons between their juxtaposed edges in the manner just described. Pivoting of the button-holding devices, first in opposite directions and then back toward the row of buttons between them, is done by fingers moved by actuating means. In order to be sure that the buttons are held firmly enough when pressed down against the work piece, a wedging device is located where the button-holding devices will engage it as they are moved down. The wedging action produces a force on each button-holding device at a location relative to the pivot axis of that device to force the juxtaposed edges more firmly against the buttons. The extra force on the buttons is accommodated by a strip material at the bottom of the respective groove in the juxtaposed edges.

Because the buttons were originally placed on pins at known locations on the supporting arm and are always held under control with no chance to move, the sewing machine can be programmed to form the stitches to attach them to the work piece without the necessity of human intervention. This not only results in a higher production rate but also neater garments, since every button will be precisely spaced from the others and all of the button holes will be oriented in the same angular positions.

It is frequently desirable to change from sewing a certain number of buttons, for example, three buttons, on each sleeve of one batch of sleeves to sewing a different number, for example, four, on the next batch and later to change back to the original number or, perhaps, to still another number. In order to facilitate the changeover, the structure that holds the buttons and moves them into the proper position to be grasped and held while they are being sewn in place may be divided into separate parts joined together by a quick-change structure similar to the quick-change structure in my U.S. Pat. No. 4,763,587. In addition, the button-holding means may be made separately adjustable to accommodate buttons of different size, particularly those that have the same hole pattern to receive threads to attach them to a sleeve.

DETAILED DESCRIPTION OF THE INVENTION

Figure 1:
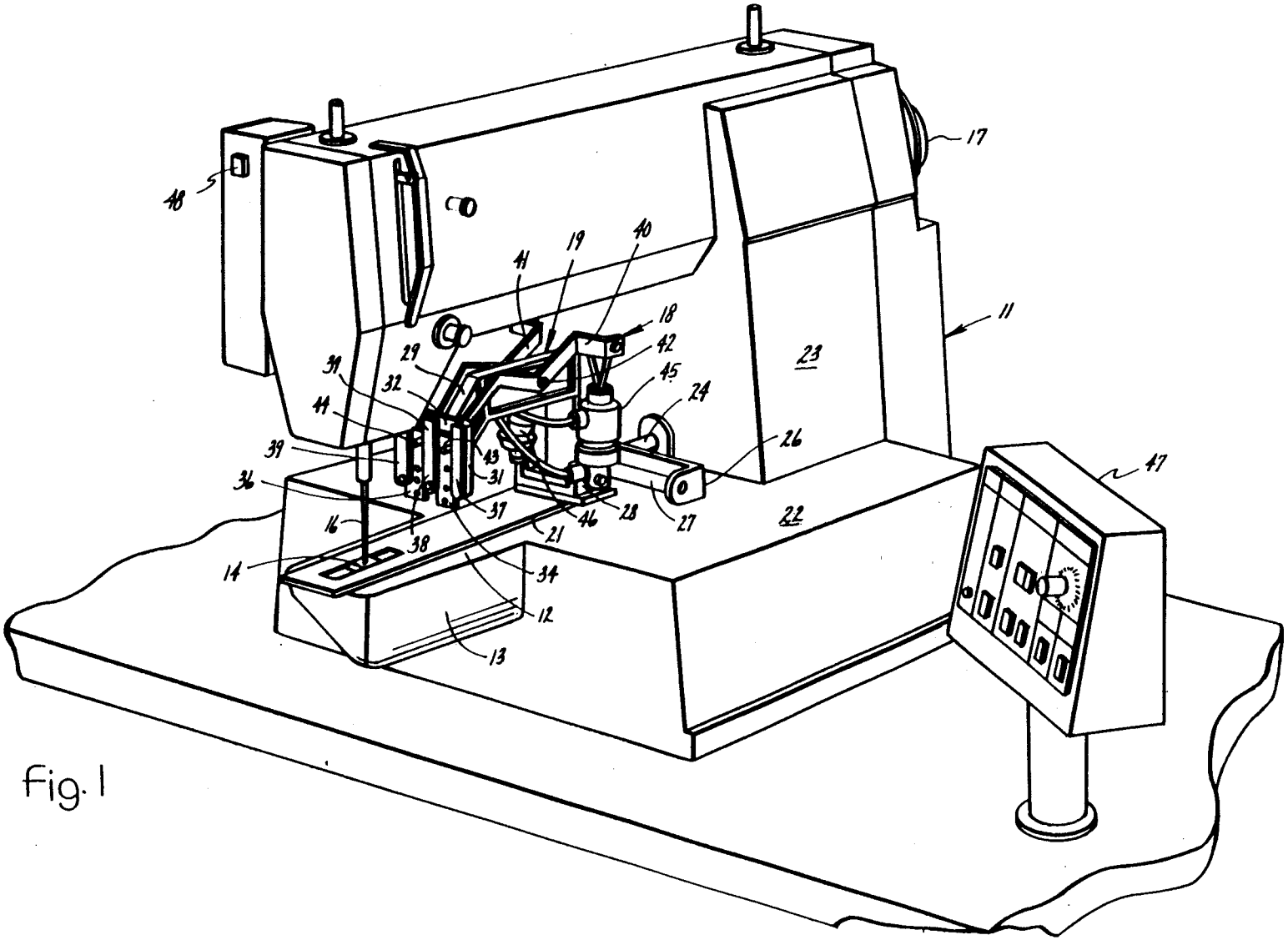
FIG. 1 is a perspective view of a programmable sewing machine.

The sewing machine 11 in FIG. 1 is to be considered as representative of electronically programmable machines suitable for this invention. The machine shown is a Brother BAS-310 machine, but it is also possible to use other programmable machines, such as those made by Mitsubishi, Juki, and others. Since the most common use for this invention is to attach a row of buttons to a sleeve, it is preferable to use a cylinder bed machine. The machine 11 has a bed 12 with a cylindrical extension 13. The cylinder encloses part of the stitch-forming mechanism, specifically, the loop-taker, under a throat plate 14. A needle 16 constitutes the other main part of the stitch-forming mechanism, and both of these parts are driven by power supplied from an electric motor (not shown) connected to the mechanism in the machine 11 by a pulley 17.

The machine includes work-holding means 18 comprising a work holder 19 and a cloth plate 21 joined to the work holder. The work holding mechanism is moved about on the bed 12 by motors within the base 22 and the housing 23. The work-holding mechanism 18 is moved in the Y direction, which is parallel to the central plane of the cylinder 12, by force transmitted through a shaft 24 connected to a yoke 26 that supports a second shaft 27 that extends in the X direction. The shaft 27 is connected to the work holder 19 and, through it, to the cloth plate 21. The work-holding mechanism is moved in the X direction by a motor (not shown) in the base 22.

The work holder 19 in the machine 11 includes a base 28 and an arm 29, one end of which is rigidly attached to the base, to which the cloth plate 21 is also rigidly attached. The free end of the work holder arm has a vertical plate 31 that has vertical slots 32 and 33 to guide the movement of a clamp foot toward and away from the cloth plate. In place of the two vertical portions of clamp feet that normally occupy the slots 32 and 33, there are two vertical races 34 and 36 that constitute part of the structure of this invention and are retained in the slots by vertical guides 37–39.

The front ends of two arms 40 and 41 pivotally mounted on a pin 42 through the work holder arm extend through apertures 43 and 44 in the vertical races 34 and 36. As the arms 40 and 41 pivot in the clockwise direction, the vertical races are raised from the positions in which they are shown to a higher position. Conversely, when the arms 40 and 41 pivot in the counterclockwise direction, the vertical races descend in their respective slots. In the machine 11, the arms 40 and 41 are moved by two pneumatic cylinders 45 and 46 attached to the work holder 19, although other programmable machines employ different means to operate arms that perform the same function.

The machine 11 also includes a controller 47 and a main switch 48.

Figure 3:
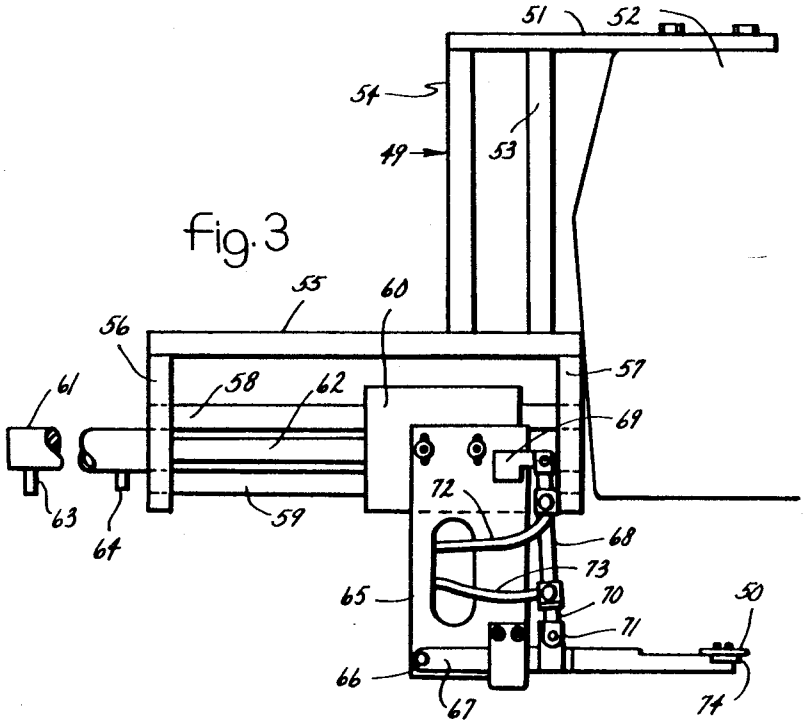
FIG. 3 is a front view of the transport apparatus of FIG. 2 according to this invention.
Figure 2:
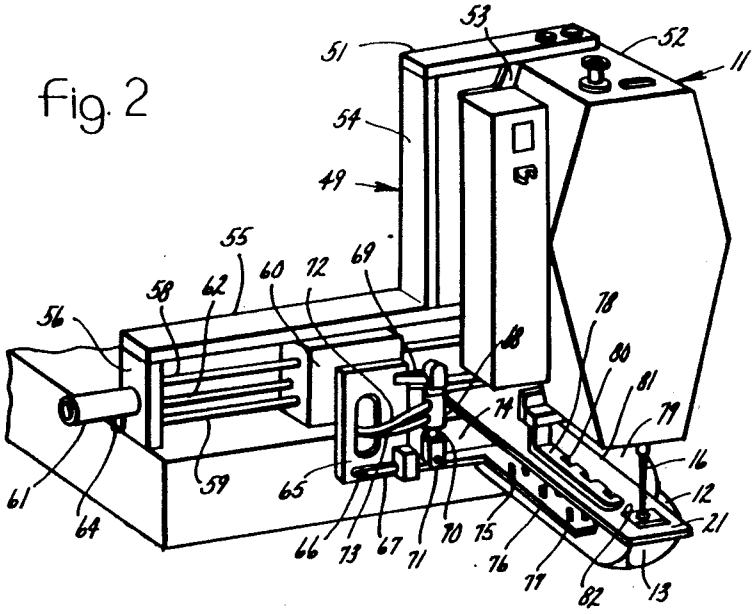
FIG. 2 is a perspective view of apparatus to transport rows of buttons to the machine in FIG. 1 and to hold those buttons in accordance with this invention.

FIGS. 2 and 3 show only a fraction of the machine 11 to which is attached a frame 49 for a transport mechanism to carry buttons 50 to the stitch-forming region of the machine. The frame includes a horizontal bar 51 bolted to the top of the horizontal arm 52 of the machine 11. Two vertical bars 53 and 54 extend down from the bar 51 and are rigidly connected to a second horizontal bar 55. Two plates 56 and 57 extend down from the bar 55, to which they are rigidly attached, and they hold the ends of a pair of parallel shafts 58 and 59 that guide the movement of a carriage 60. Motive power to move the latter back and forth on the shafts 58 and 59 is supplied by a pneumatic cylinder 61 attached to the plate 56 and provided with a piston connected to the carriage 60 by a connecting rod 62. Air is supplied to the cylinder through two air lines 63 and 64 to drive the carriage to the right when the pressure in the line 63 is greater than that in the line 64 and back to the left when the pressure in the two lines :s reversed.

A plate 65 rigidly attached to the carriage 60 has a pivot pin 66 on which an arm 67 is pivotally mounted. The arm 67 is limited to a very small amount of movement in response to actuation of another pneumatic cylinder 68. One end of the cylinder is connected to a fixed arm 69 attached near the top of the plate 65, and a piston in the cylinder is connected by way of a connecting rod 70 and a clevis 71 to the arm 67. Air is supplied to the cylinder 68 by two air hoses 72 and 73. When the pressure in the hose 72 is greater than that in the hose 73, the arm 67 is pivoted counterclockwise. When the pressure in the line 73 is higher than that in the line 72 the arm 67 pivots clockwise to the limited extent it can do so.

In the perspective view in FIG. 2 it can be seen that another arm 74 extends perpendicularly from the free end of the arm 67 and that the arm 74 in this embodiment has three sets of pins 75–77 extending upwardly from its upper surface. Each set is arranged according to the thread holes in a button, and the sets are spaced apart along the arm 74 according to the center-to-center spacing from button to button, and the arm 74 extends parallel to the cylinder 13. The carriage 60 is shown in an intermediate position; normally, when buttons 50 are to be placed on the three sets of pins, the button-supporting arms 65 and 73 are farther to the left so as to be farther from the stitch-forming region of the machine 11, thereby giving the operator more room. However, there is no fixed location to which the button-supporting arms must move; they will stop wherever the controls have been set to cause them to stop.

After the buttons have been loaded on the pins, the controls for the machine can be actuated to cause the pneumatic cylinder 61 to move the carriage 60 and arms 67 and 74 to the right to bring the arm 74 over the center line of the cylinder 13. At that time, two button-holding devices 78 and 79 must be spread apart, in the positions shown, to allow room for the the buttons supported on the arm 74 to be brought directly in line with the juxtaposed edges 80 and 81. In order to transport the buttons to that position, the cylinder 61 must not only move the carriage fully to the right, but the small cylinder 68 must elevate the free end of the arm 67, thereby elevating the entire arm 74. It can be seen that there is little vertical space between the cloth plate 21 and the button-holding devices 78 and 79, and so it is not necessary to pivot the arm 67 more than just a few degrees counterclockwise.

Once the buttons 50 on the arm 74 are substantially in the plane of the juxtaposed edges 80 and 81, the devices 78 and 79 can be forced toward each other until they encounter the edges of the buttons. At that time, the edges of the devices 78 and 79 are still far enough above the cloth plate 21 to allow the arm 67 to pivot back in the opposite, or clockwise, direction to move the pins down and completely out of the buttons, which are entirely supported by the button-holding devices 78 and 79. Once the tops of the pins 75–77 are lower than the bottom surfaces of the buttons, the cylinder 61 can return the carriage 60 and the arms 67 and 74 to the left to be entirely out of the path of any part of the stitch-forming mechanism and of the buttons and the devices 78 and 79.

It will be observed that the devices 78 and 79 are directly alongside an elongated slot 82 in the cloth plate 21. This slot is long enough to allow the stitches for all of the buttons in a row to pass through. Since the cloth plate is affixed to the work holder 19 (FIG. 1) to which the devices 78 and 79 are attached, the devices 78 and 79 will be over the same region of the cylinder 13 as the slot 82. The arm 74 is only capable of moving transversely and not longitudinally with respect to the cylinder 13, and so it is necessary to be sure that the devices 78 and 79 are properly positioned with respect to the longitudinal dimension of the cylinder 13 so that the precisely correct parts of the juxtaposed edges 79 and 81 will engage the buttons placed between them.

Figure 5:
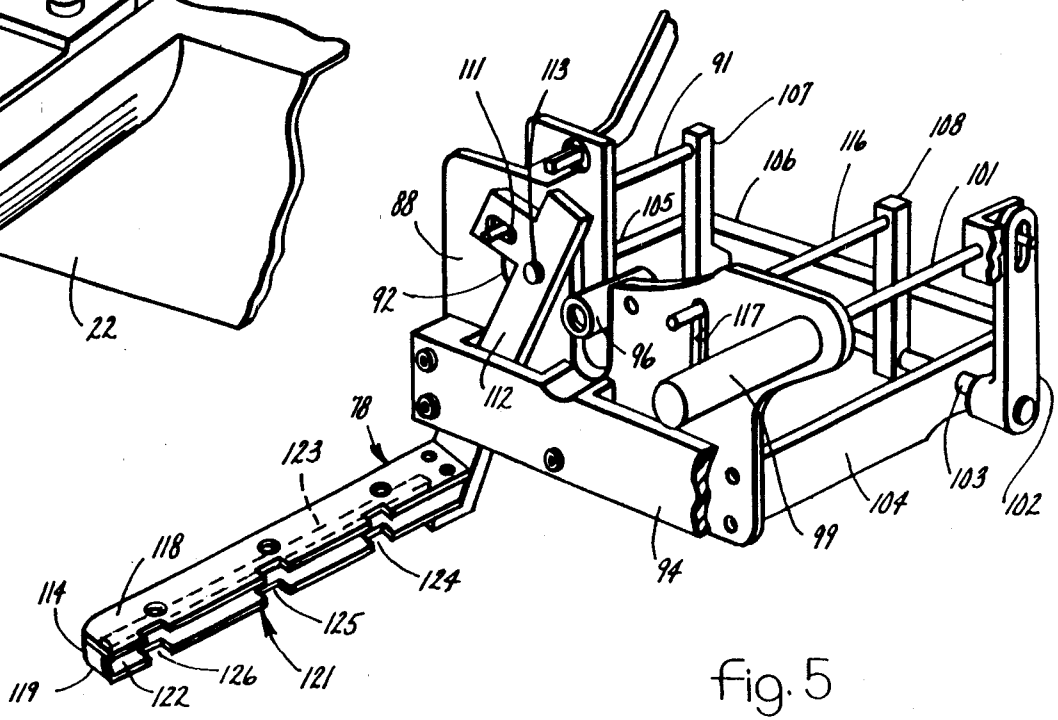
FIG. 5 is a perspective view of part of the button-holding apparatus in FIG. 2.
Figure 4:
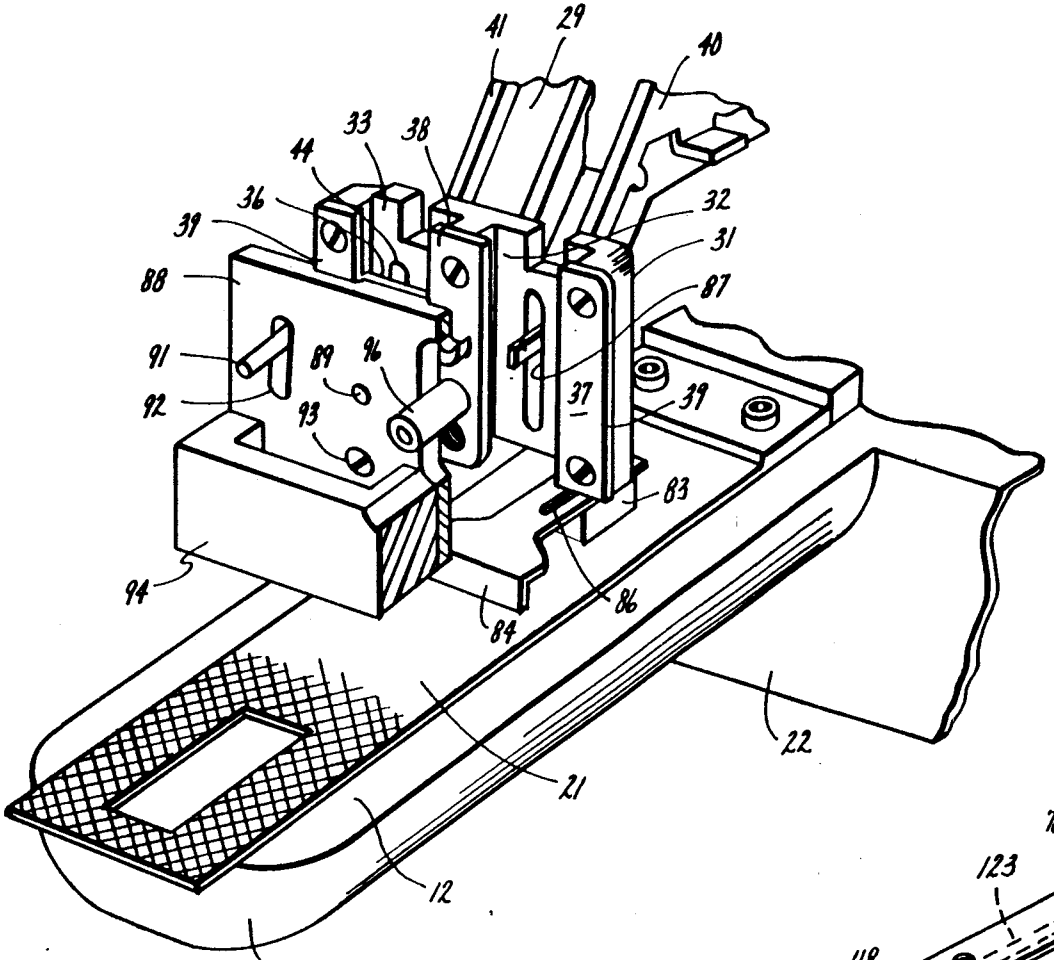
FIG. 4 is a perspective, fragmentary view of the work holder and cloth plate and part of the button-holding apparatus in FIG. 2.

FIGS. 4 and 5 show the structure that supports and moves the button-holding means 78 and 79. The apparatus in each of these figures is only fragmentary in order to make it easier to visualize. Certain components appear in both figures, as well as in some of the other figures, and the overall structure can be understood by reference to these common components.

FIG. 4 shows the cylinder 13 and the cloth plate 21 on it. A saddle 83 is welded to the cloth plate to hold a guard 84 that can be set to determine how far a work piece is to be pushed onto the cylinder. The guard has a visible slot 86 and is secured to the saddle by a screw (not shown) through this slot, so that the position of the guard can be adjusted.

Above the cloth plate is the work holder arm 29 and the vertical plate 31 at its end. Both of the slots 32 and 33 are shown to some extent, but only one vertical race 36 is shown in order to allow more of the slot 32 to be visible. In the absence of a vertical race in the slot 32, it is possible to see the slot 87 in which the arm 40 is free to move vertically. There is a similar slot for the arm 41, but it is behind the vertical race 36.

FIG. 4 also shows part of a main support plate 88 on which both the of the button-holding devices 78 and 79 are pivotally mounted, but neither of those devices is shown in this figure. A hole 89 is shown in which the pivot pin for one of the devices is to be placed. In addition, a finger 91 that passes along the far edge of the vertical plate 31 is shown extending through a vertical slot 92 in the main support plate, and it is to be understood that a similar finger extends through a similar slot alongside the near edge of the vertical plate 31.

The main support plate is attached to the vertical race 36 and the other vertical race 34 that is not shown in this figure by means of several machine screws, only one of which is shown. This is the screw 93.

Also shown is half of a guard 94 that is more completely shown in FIG. 5. In addition, there is a central stud 96 rigidly mounted on the vertical barrier 38 and extending through a vertical slot 97 in the main support plate 88. This stud, but not its fixed mounting, is also shown in FIG. 5.

FIG. 5 shows the mechanism for moving the button-holding devices 78 and 79 apart and then moving them back toward each other to grasp a row of buttons. By comparison of the locations of the main support plate 88, the finger 91, the guard 94, and the stud 96 in FIGS. 4 and 5, the way the structure in FIG. 5 combines with that in FIG. 4 is clear.

The structure in FIG. 5 also includes a pneumatic cylinder 99 that actuates the button-holding device 78 and the other button holding device 79, not shown in this figure but shown in FIG. 2 as being symmetrical with the device 78. The piston in the cylinder 99 is connected by a connecting rod 101 to a crank arm 102 rigidly mounted on a shaft 103, which is pivotally mounted in two side members 104 and 105 rigidly attached to the main support plate 88. A rear support 106 is attached to the rear ends of the side members to complete a rectangular structure that extends around the vertical plate 31 in FIG. 4.

In addition to the crank arm 102, two other arms 107 and 108 are also rigidly attached to the shaft 103, for example, by set screws. The finger 91 projects forward from the arm 107 and extends through the slot 92 and through a horizontal slot 111 in a bracket 112 that forms part of the button-holding device 78. The bracket is pivotally mounted on a pin 113 that is held in place in the hole 89 shown in FIG. 4. When air pressure in the cylinder 99 forces the crank arm 102 to pivot clockwise, the shaft 103 rotates in the same direction, carrying with it the arm 107. This tilts the finger 91 up and causes it to pivot the bracket 112 clockwise, which moves the clamp portion 114 of the button-holding device 78 outward relative to the central plane of the structure in FIG. 5. Reversing the air pressure in the cylinder 99 reverses the pivoting of the crank arm 102, the shaft 103, the arm 107, the finger 91, and the bracket 112. As a result, the clamp portion of the button-holding device 78 moves back toward the center, the direction it would move to grasp the edge of a button if one were there to be grasped.

Although the other button-holding device 79 is not shown in FIG. 5 in order not to clutter up the drawing, it is clear that it would move in the opposite direction from that in which the device 78 moves. This is because a finger 116 attached to the arm 108 extends through a slot 117 symmetrical with the finger 91 and slot 92 in the main support member 88.

The clamp portion 114 is made with upper and lower plates 118 and 119, respectively. The length of the clamp portion is determined by the number and diameter of the buttons to be sewn on each work piece. Along the edge 121, which is the edge that confronts the clamp portion of the other button-holding device 79 and has been referred to previously in this description as a juxtaposed edge, there is a gap between the upper and lower members. This allows the edges of the buttons to fit into the resulting groove 122. Between the upper and lower members 118 and 119, and forming the bottom of the groove 122, is a strip of elastomeric material 123. It is actually this material that the edges of the button are pressed against, and the elastic properties of the material allow the pressure on the buttons to be increased considerably to be certain that they do not slip. In this embodiment, the proper locations of the buttons are indicated by three notches 124–126 that allow extra space for forming the stitches to attach the buttons to a work piece.

While the fingers 91 and 116 apply some pressure to the button-holding devices 78 and 79 to cause them to grip the buttons securely, the fact that the clamp portion 114 of the device 78 and the similar part of the other device 79 are pressed firmly against each work piece to hold it in place as the work piece and the buttons move from one button-attaching position to the next makes it desirable to provide extra pressure to force the devices 78 and 79 toward each other. This is accomplished by the stud 96, which serves as wedging means. As the pneumatic cylinders 45 and 46 in FIG. 1 force the arms 40 and 41 to pivot counterclockwise relative to the positions in which they are shown, the front ends of these arms push the vertical races 34 and 36 down, thereby forcing the main support plate and everything attached to it down. The stud 96, however, does not move. The upper ends of the bracket 112 and its mirror image twin extend part of the way across the slot 97, and, as the main support plate goes down, these ends of the brackets engage the stud, which wedges them apart. Being so wedged causes the lower ends of the brackets on which the clamp portions are mounted, to move toward each other with even greater force than the fingers 91 and 116 can apply.

Figure 7:
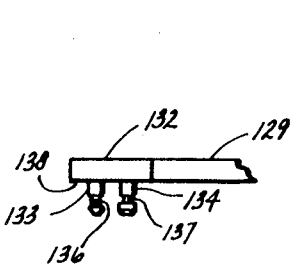
FIG. 7 is a fragment of the apparatus in FIG. 6.
Figure 6:
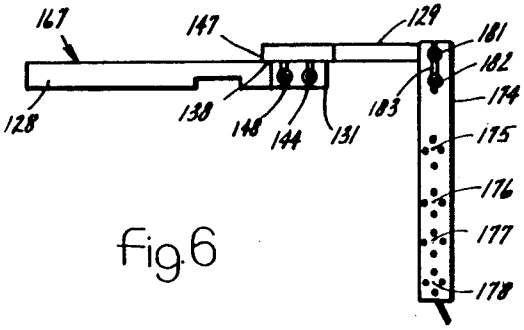
FIG. 6 is a plan view of a modified form of apparatus shown in FIG. 2 to transport buttons to apparatus that holds them while they are being sewn in place.
Figure 8:
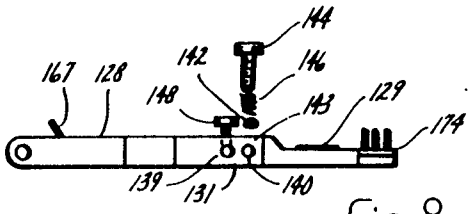
FIG. 8 is a front view of the apparatus in FIG. 6.

FIGS. 6–8 show modified arms 167 and 174 to feed buttons to the button-holding devices 78 and 79 in FIG. 2. The arm 167 consists of two parts 128 and 129 that are shown as having overlapping ends 131 and 132, respectively. As shown in FIG. 7, the end 132 in this embodiment has two parallel pins 133 and 134, each with a detent groove 136 and 137, respectively, around it at a predetermined location from the surface 138 of the end 132. The pins 133 and 134 fit precisely in openings 139 and 140 in the end portion 131 of the part 128 and are held therein by detent means.

As shown in FIG. 8, one of the detent means includes a ball 142 that fits into a hole 143 in the end 131 and is held in place by an adjustment screw 144 that presses a spring 146 against the ball. The hole 143 is aligned with the hole 140 and is spaced from the surface 147 of the end part 131 by the same distance that the groove 137 is spaced from the surface 138 so that, when the pins 133 and 134 are fully inserted into the holes 139 and 140, the ball 142 will be forced into engagement with the groove 137.

In the same manner, another detent screw 148 threaded into a hole 149 aligned with the hole 139 controls another detent spring and ball that are not shown but are like the spring 146 and the ball 142. Together, the detent balls controlled by the screws 144 and 148 exert enough pressure on the pins 134 and 133, respectively, to hold the part 129 firmly in place on the part 128 and accurately positioned with respect thereto, while still allowing the part 129 to be removed from the part 128 by the operator, using finger pressure and without using tools, so as to replace an arm 174 having one pattern of button-holding pins with another such arm having a different pattern of pins.

The arm 174 differs from the arm 74 in FIG. 2 by having four sets of pins 175–178. Each of these pins extends perpendicularly from the top surface of the arm 174, and the pins of each set are spaced apart according to the holes in buttons to be sewn to a work piece. The arm 174 is attached to the end of the part 129 by two set screws 181 and 182 that pass through an elongated slot 183 in the arm 174. One of the reasons for making this slot elongated is to allow the arm 174 to be positioned so that the buttons held on the sets of pins 175–179 can be held in the proper positions to be sewn in proper positions on a work piece. As it happens, there are buttons of different diameters that have the same thread hole arrangements and can be sewn to a work piece by a programmable machine using the same stitch-forming program, and the slot 183 facilitates placing such buttons properly.

While this invention has been described in terms of a specific embodiment, it will be understood that modifications may be made therein without departing from the scope hereof.

What is claimed is:

1. In a programmable sewing machine having a bed, stitch-forming means, work-holding means comprising a work holder and a cloth plate attached to the work holder, and means to move the work-holding means to selected points relative to the bed according to a program, the improvement comprising:

(a) first and second button-holding means separable relative to each other;

(b) means supporting the button-holding means to be movable relative to each other and to the work-holding means;

(c) means to move the button-holding means apart to release buttons between the first and second button-holding means and to move the button-holding means toward each other to grasp the buttons therebetween;

(d) button-supporting means to support a plurality of buttons;

(e) means to move the button-supporting means to a predetermined location to place the buttons supported thereon in position to be grasped by the button-holding means; and (f) means to move the button-holding mean sand the buttons grasped thereby toward the bed to place the buttons in a predetermined position relative to a work piece thereon.

2. The invention of claim 1 wherein the means to support the button-holding mans comprises main support means movably supported on the work holder.

3. The invention of claim 1 wherein the means to support the button-holding means comprises first and second pivotal support means for the first and second button-holding means, respectively.

4. The invention of claim 1 wherein the first and second button-holding means comprise laterally separable clamping jaws to hold the buttons and to clamp the work piece to retain each of the buttons in a predetermined position relative to the work piece.

5. The invention of claim 4 wherein the machine is a cylinder bed machine and the laterally separate clamping jaws extend substantially parallel to an axis of the cylinder bed.

6. The invention of claim 5 wherein the separable clamping jaws comprise juxtaposed grooved surfaces, edge portions of the buttons fitting into the grooves.

7. The invention of claim 6 comprising resilient means defining at least a bottom portion of the groove of at least one of the clamping jaws to apply substantially equal force to all of the buttons.

8. The invention of claim 6 wherein each of the clamping jaws comprises elastomeric means to engage edge portions of buttons held by the clamping jaws.

9. The invention of claim 6 wherein each of the clamping jaws comprises an elongated elastomeric member defining the bottom of a respective groove in that clamping jaw.

10. In a programmable sewing machine having a cylinder bed, stitch-forming means at a fixed location relative to the bed, work-holding means comprising a work holder and a cloth plate attached to the work holder, and means to move the work-holding means to selected points on he bed according to a program, the apparatus comprising;

(a) main support means movably mounted on the work holder;
(b) means to move the main support means toward and away from the bed;
(c) first and second button-holding means pivotally mounted on the support means by means comprising a pivotal axis and comprising first and second clamping jaws with juxtaposed edges extending substantially parallel to the cylinder bed and movable toward and away from each other to grasp buttons between said edges;
(d) button-supporting means to support a plurality of buttons in predetermined space relationship with respect to each other along a line parallel to the cylinder bed;
(e) means to move the button-supporting means to place each of the buttons supported thereon in a respective predetermined location between the juxtaposed edges of the first and second button-holding means;
(f) means to move the juxtaposed edges toward each other to grasp the buttons; and
(g) means to move the button-holding means toward the bed to a predetermined position relative to a work piece thereon.

11. The apparatus of claim 10 wherein the button-supporting means comprises:
(a) a carriage;
(b) guide means supporting the carriage for movement toward and away from the button-holding means in a direction lateral to an axis of the cylinder bed;
(c) a transfer arm movably mounted on the carriage;
(d) bracket means extending parallel to the axis of the cylinder bed and comprising a plurality of pins at predetermined locations to hold the plurality of buttons in specific orientations and spaced a predetermined distance apart;
(e) mean to move the carriage along the guide means to move the bracket means to a location between and below the clamping jaws; and
(f) mean to elevate the bracket means to lift the buttons thereon to a level for grasping by the clamping jaws.

12. The invention of claim 10 wherein the means to move the juxtaposed edges toward each other comprises:
(a) pivotal arm means supported by the main support means and engaging the button-holding means; and
(b) means to pivot the pivotal arm means, for further pivoting the button-holding means to separate the clamping jaws when the pivotal arm means pivots in one direction and to move the clamping jaws toward each other when the pivotal arm mean pivot in the opposite direction to said one direction.

13. The apparatus of claim 12 comprising:
(a) an axle supporting the pivotal arm means;
(b) a pneumatic cylinder mounted on the main support means; and
(c) separate arm means rigidly mounted on the axle and connected to the pneumatic cylinder to be pivoted by said pneumatic cylinder to pivot the axle and, thereby, the pivotal arm means.

14. The apparatus of claim 13 wherein each of the button-holding means comprises a first part having opposite ends and being pivotally mounted on the main support, the pivotal axis of each of the button-holding means being between the respective ends of the first part with the clamping jaws being at one end of the first part, said apparatus further comprising wedging means to engage the first parts between the pivotal axis and the other end of each of the first parts when the button-holding is moved to a certain proximity to the work piece, thereby exerting a force on each of the first parts to press the clamping jaws more forcefully together.

15. The apparatus of claim 14 in which the main support means slides parallel to a surface of the work holder and has a central slot between the first part of each of the button-holding means, and the wedging means comprises a projection affixed to the work holder and extending through the slot to engage the first part of each of the button-holding means.

16. The apparatus of claim 10 in which:
(a) the button-supporting means comprises a first arm having a first part pivotally mounted on the main support means;
(b) a second part;
(c) detent means cooperating with associated means connecting the second part to the first part securely but hand-releasably; and
(d) a second arm attached to the second part and extending at an angle thereto and substantially parallel with the cylinder bed and comprising alignment means to support the buttons at predetermined positions along the second arm.

17. A method for sewing a row of buttons, each having at least one stitch aperture, at predetermined respective positions along a work piece, said method comprising the steps of:
(a) feeding the row of buttons to gripping means, each of the buttons being placed in a predetermined position relative to the gripping means on a programmable sewing machine having stitch-forming means and with each stitch aperture at a predetermined orientation;
(b) gripping the buttons from opposite sides of the row while maintaining a known orientation of each stitch aperture;
(c) bringing the row of buttons into predetermined relation with respect to the work piece;
(d) moving the buttons and the work piece to a succession of locations to bring a stitch aperture of each button in turn into alignment with the stitch-forming mechanism; and
(e) forming stitches to attach each button, in turn, to the work piece.

18. The method of claim 17 wherein the step of feeding each of the buttons to a respective predetermined location relative to the gripping means comprises:
(a) placing each of the buttons on aligned pins extending upward from a support that extends parallel to the row;
(b) moving the support to a predetermined location relative to the sewing machine;
(c) elevating the buttons to a level at which they can be gripped; and
(d) moving the support away from the gripping means after the buttons on it have been gripped.

19. The method according to claim 18 wherein the step of feeding each of the buttons to a respective predetermined location relative to the gripping means comprises:
(a) moving the support in a first direction perpendicular to the row and to a location below the level at which the buttons can be gripped;

(b) pivoting the support to elevate the buttons to the level at which they can be gripped; and (c) pivoting the support in a reverse direction after the buttons have been gripped to bring tops of the pins below a level of bottoms of the buttons.

20. The method of claim 17 wherein the buttons are gripped by opposing, pivotally mounted jaws, and the method further comprises:

(a) pivoting the jaws apart to allow the buttons to be fed between them;

(b) pivoting the jaws toward each other to grip the row of buttons; and (c) wedging the jaws toward each other to increase the grip on the buttons as the row of buttons is brought into predetermined relation with respect to the work piece.

* * * * *